US005123766A

United States Patent [19]

Babiak

[11] Patent Number: 5,123,766

[45] Date of Patent: Jun. 23, 1992

[54] CORRECTION FLUID DISPENSING PEN

[76] Inventor: Charles Babiak, 123 Glenridge, East Aurora, N.Y. 14052

[21] Appl. No.: 699,572

[22] Filed: May 14, 1991

[51] Int. Cl.[5] ..... B43K 5/06

[52] U.S. Cl. ..... 401/180; 401/176; 401/278; 401/173; 401/202; 401/269

[58] Field of Search ..... 401/179, 181, 182, 278, 401/279, 280, 281, 206, 180, 176, 171, 173, 177, 202, 269

[56] References Cited

U.S. PATENT DOCUMENTS

| | | | |
|---|---|---|---|
| 2,127,794 | 8/1938 | Wastman | 401/171 X |
| 3,144,676 | 8/1964 | La Mura | 401/176 X |
| 4,892,427 | 1/1990 | Ford | 401/176 X |

FOREIGN PATENT DOCUMENTS

| | | | |
|---|---|---|---|
| 512660 | 2/1955 | Italy | 401/176 |
| 94190 | 4/1922 | Switzerland | 401/179 |
| 307815 | 8/1955 | Switzerland | 401/269 |
| 2202733 | 10/1988 | United Kingdom | 401/176 |
| 2211081 | 6/1989 | United Kingdom | 401/180 |

*Primary Examiner*—Danton D. DeMille
*Attorney, Agent, or Firm*—Leon Gilden

[57] ABSTRACT

A dispensing pen includes a cylindrical body formed with a conically tapered forward end, with the forward end including a spherical or brush applicator. The cylindrical body includes an end cap threadedly mounted thereon, with the end cap housing a piston, with the piston biased within the cylindrical body to effect pressurizing of a fluid reservoir contained within the cylindrical body to direct such fluid through the applicator brush or spherical member of the applicator. The pressurizing piston mounted within the end cap includes a biasing means and a regulator to maintain pressurizing of the fluid, wherein alternatively, the piston includes a piston body that is externally threaded mounted within an internally threaded interior wall of the end cap to effect pressurizing of the reservoir.

3 Claims, 4 Drawing Sheets

10
25
15
11
12
16
18

15
11
12
17
18

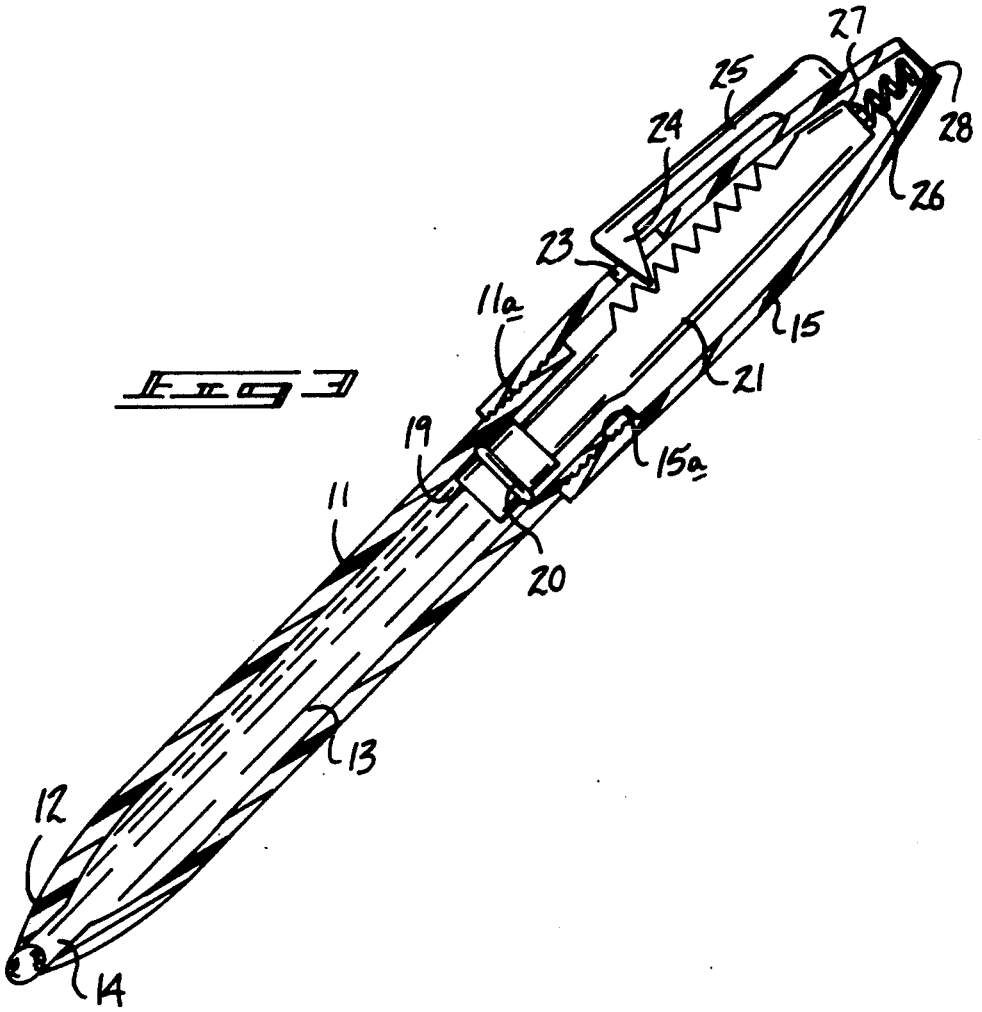
FIG 3
FIG 4
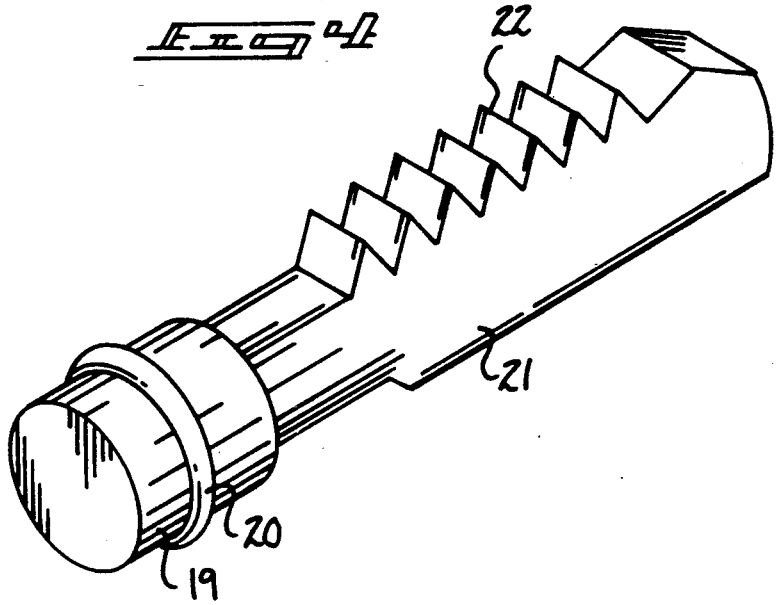

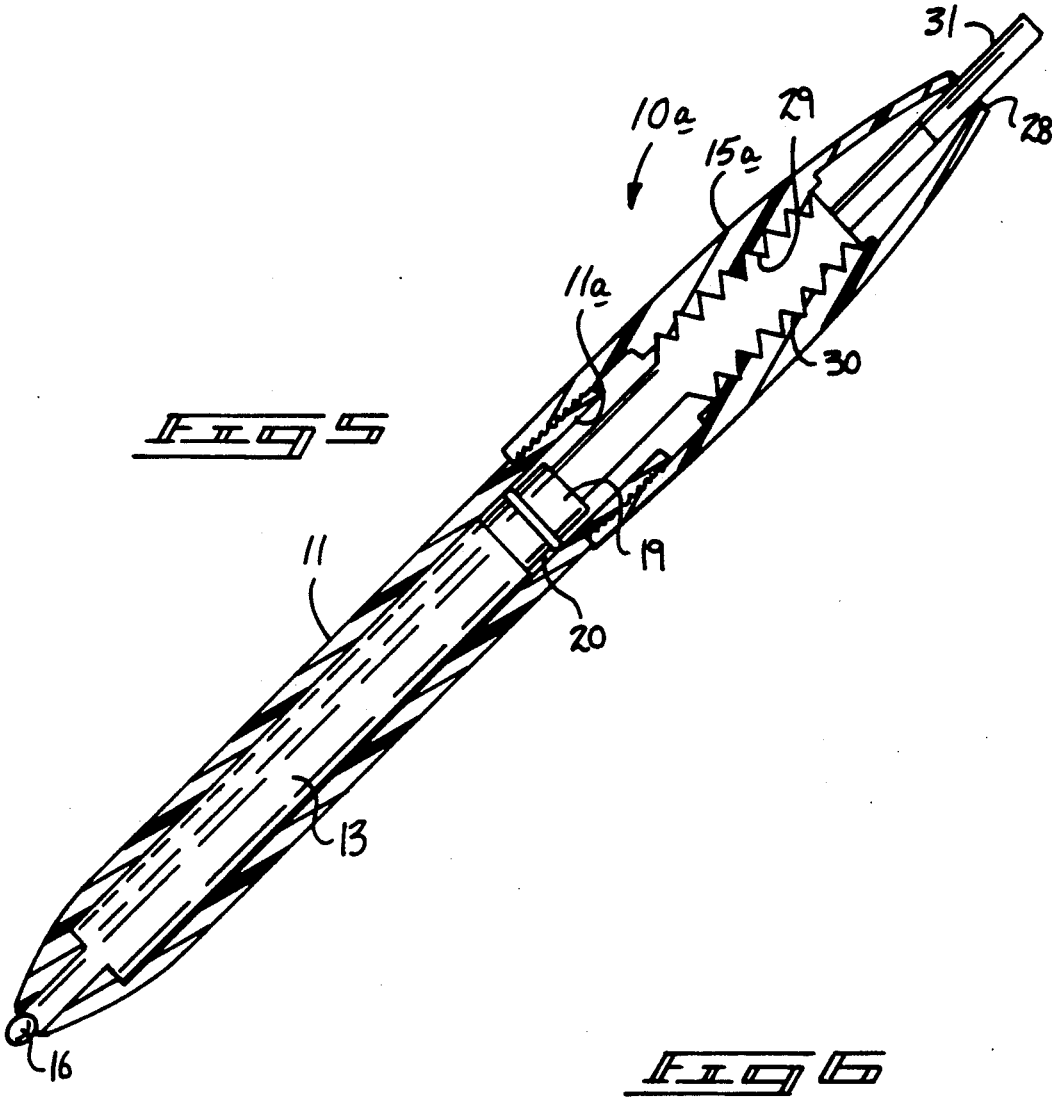
FIG 5
FIG 6
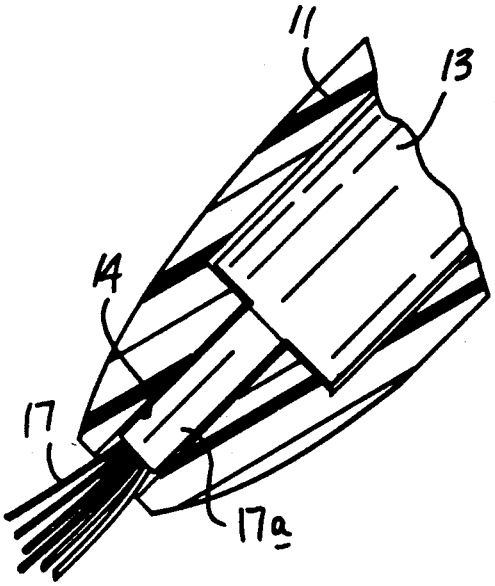

CORRECTION FLUID DISPENSING PEN

BACKGROUND OF THE INVENTION

1. Field of the Invention

The field of invention relates to pen apparatus, and more particularly pertains to a new and improved correction fluid dispensing pen wherein the same is arranged for directing fluid through a forward end thereof.

2. Description of the Prior Art

Various pen structures have been utilized in the prior art. Frequently, correction fluid is typically provided in brush applicator form contained within a bottle, wherein the brush applicator is directed into the bottle and removed therefrom in a subsequent manner to direct such fluid onto a written or photo-copied portion of a document to effect blanking out of various portions of the document. The instant invention attempts to overcome deficiencies of the prior art by providing a pen structure with a readily available applicator end directing pressurized fluid through a forward applicator portion of the pen.

Examples of the prior art include U.S. Pat. No. 4,156,657 to Lin setting forth a ball point pen dispensing an ink therefrom, with eradicator fluid contained at a rear end of the pen portion.

U.S. Pat. No. 4,252,845 to Griffiths sets forth a graphic arts ink and eradicator combination, wherein ink contains a dye which is reducible to a colorless form in combination with a volatile acid and a non-volatile organic acid dissolved into an aqueous solvent, with an ink eradicator containing a solution of sulfate or phosphate.

As such, it may be appreciated that there continues to be a need for a new and improved correction fluid dispensing pen as set forth by the instant invention setting forth an organization not presented by the prior art to provide correction fluid in a pressurized form for eradication of various discrete portions of a document and in this respect, the present invention substantially fulfills this need.

SUMMARY OF THE INVENTION

In view of the foregoing disadvantages inherent in the known types of pen apparatus now present in the prior art, the present invention provides a correction fluid dispensing pen wherein the same is arranged to direct dispensing fluid through a pen structure for eradication of various ink portions of an associated document. As such, the general purpose of the present invention, which will be described subsequently in greater detail, is to provide a new and improved correction fluid dispensing pen which has all the advantages of the prior art dispensing pen structure and none of the disadvantages.

To attain this, the present invention provides a dispensing pen including a cylindrical body formed with a conically tapered forward end, with the forward end including a spherical or brush applicator. The cylindrical body includes an end cap threadedly mounted thereon, with the end cap housing a piston, with the piston biased within the cylindrical body to effect pressurizing of a fluid reservoir contained within the cylindrical body to direct such fluid through the applicator brush or spherical member of the applicator. The pressurizing piston mounted within the end cap includes a biasing means and a regulator to maintain pressurizing of the fluid, wherein alternatively, the piston includes a piston body that is externally threaded mounted within an internally threaded interior wall of the end cap to effect pressurizing of the reservoir.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved correction fluid dispensing pen which has all the advantages of the prior art pen apparatus and none of the disadvantages.

It is another object of the present invention to provide a new and improved correction fluid dispensing pen which may be easily and efficiently manufactured and marketed.

It is a further object of the present invention to provide a new and improved correction fluid dispensing pen which is of a durable and reliable construction.

An even further object of the present invention is to provide a new and improved correction fluid dispensing pen which is susceptible of a low cost of manufacture with regard to both materials and labor, and which accordingly is then susceptible of low prices of sale to the consuming public, thereby making such correction fluid dispensing pens economically available to the buying public.

Still yet another object of the present invention is to provide a new and improved correction fluid dispensing pen which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic cross-sectional illustration of the invention as set forth in FIG. 1.

FIG. 4 is an isometric enlarged configuration of the piston and piston body utilized in the invention as set forth in FIG. 3.

FIG. 5 is an modification of the invention utilizing a threaded piston body.

FIG. 6 is an enlarged cross-sectional illustration of the invention setting forth the mounting of the applicator brush within an associated cylindrical support.

DESCRIPTION OF THE PREFERRED EMBODIMENT

Figure 1:
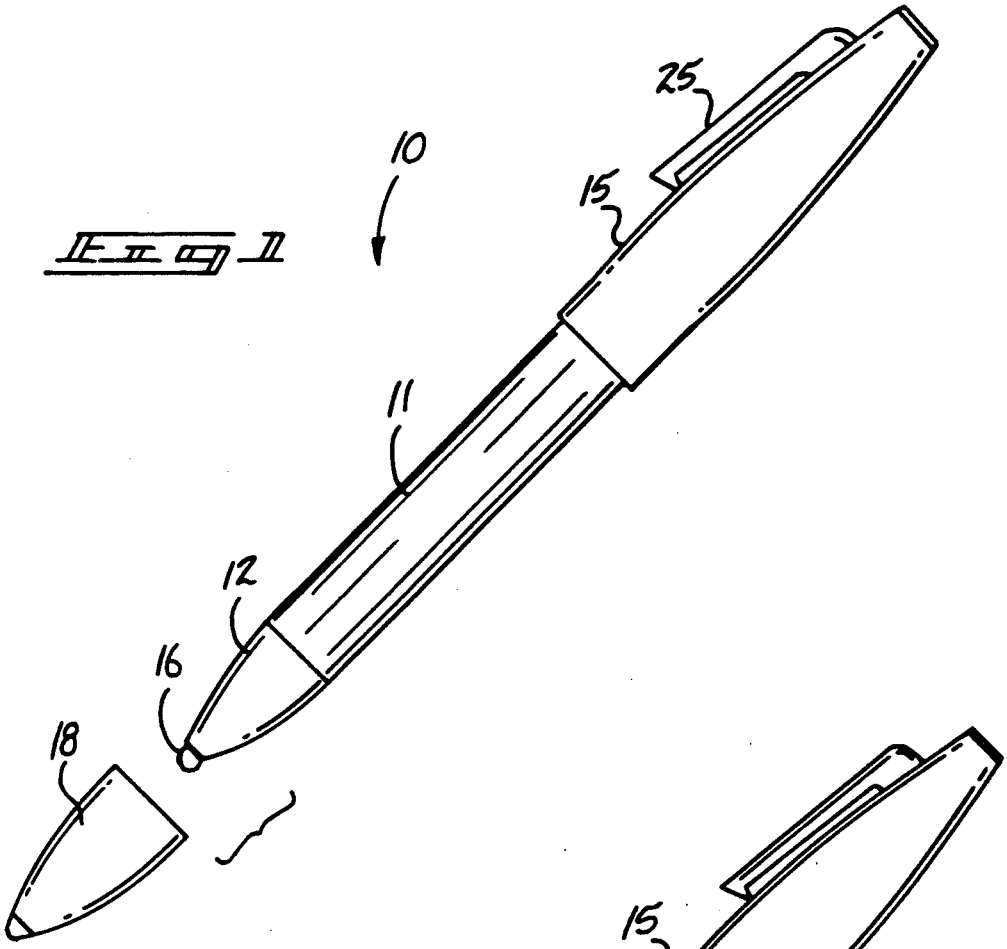
FIG. 1 is an orthographic side view of the instant invention.
Figure 2:
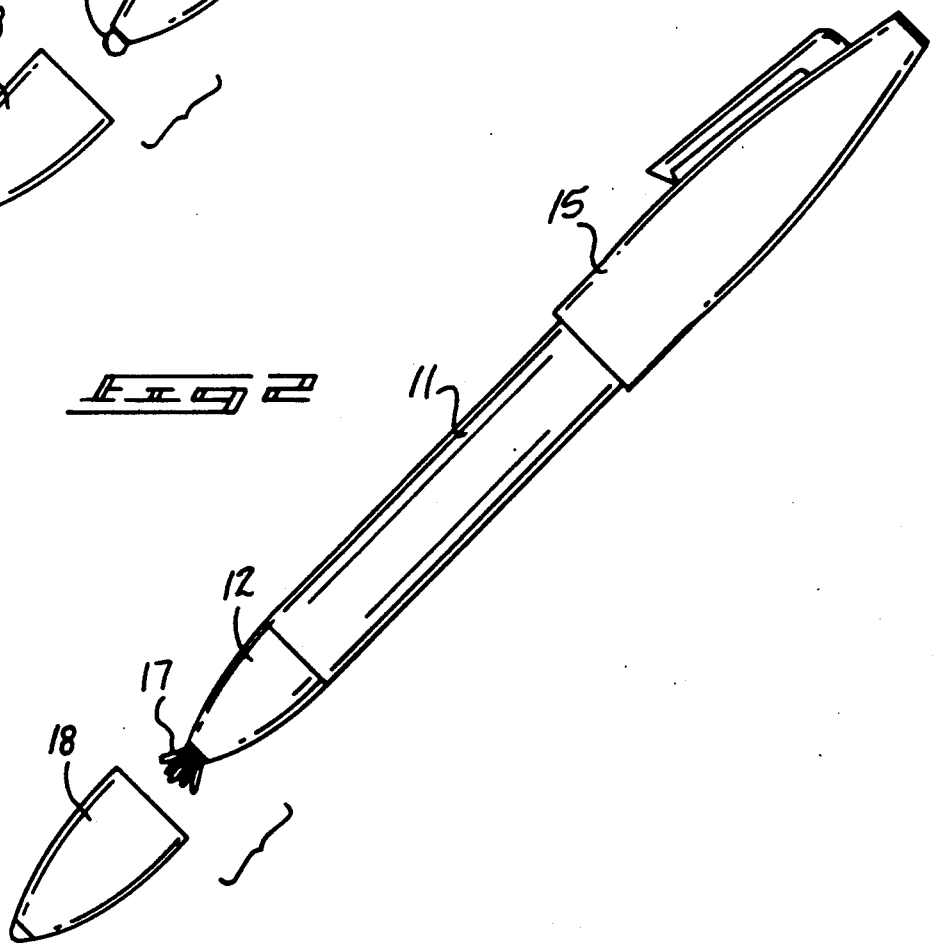
FIG. 2 is an orthographic side view of the instant invention utilizing a brush applicator.
Figure 7:
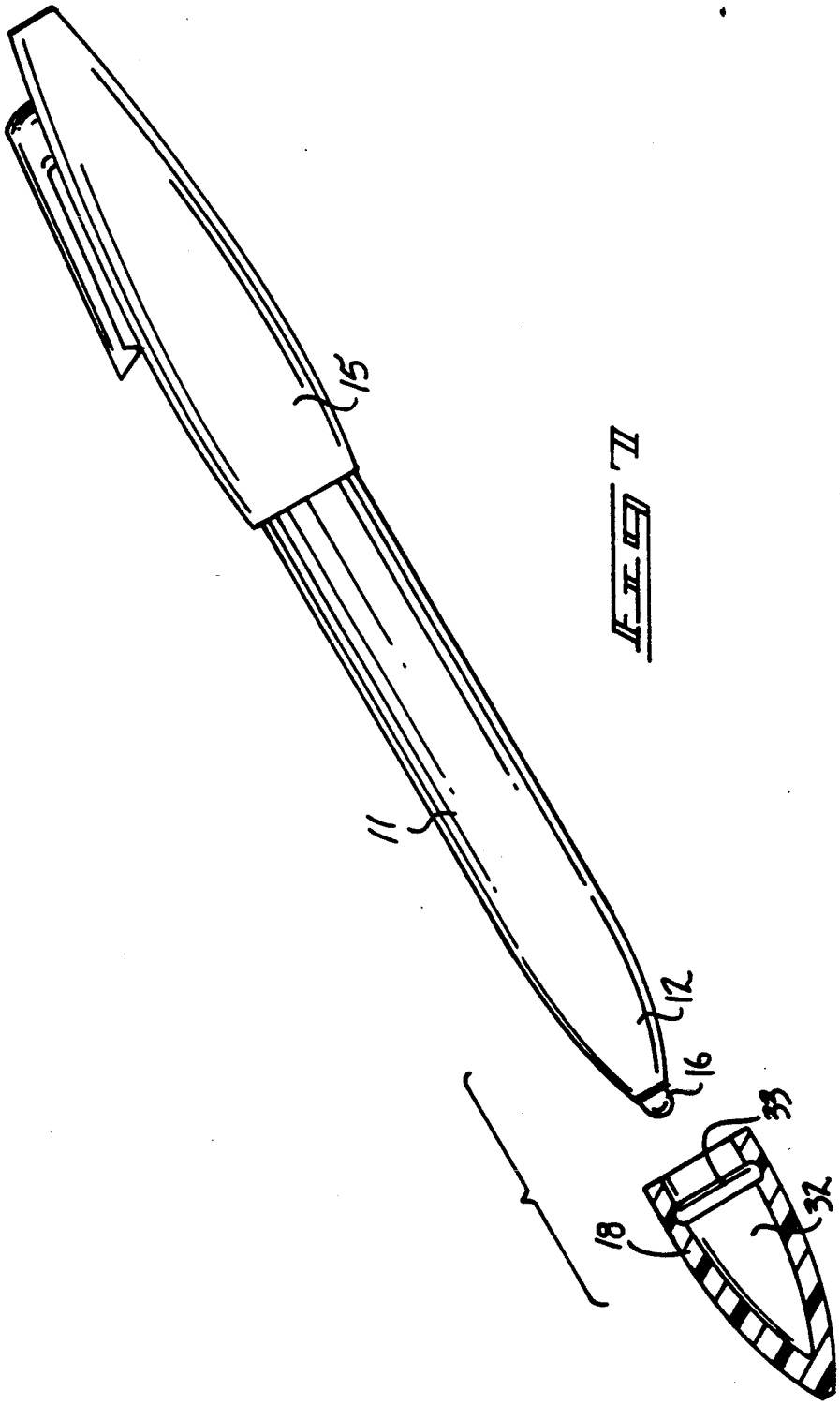
FIG. 7 is an orthographic side view of the invention illustrating the forward cap in cross-sectional illustration illustrating the configuration thereof.

With reference now to the drawings, and in particular to FIGS. 1 to 7 thereof, a new and improved correction fluid dispensing pen embodying the principles and concepts of the present invention and generally designated by the reference numerals 10 and **10*a*** will be described.

More specifically, the correction fluid dispensing pen 10 of the instant invention essentially comprises a coaxially aligned cylindrical body 11, including a conically tapered forward end 12, with a fluid reservoir 13 contained within the cylindrical body 13, and a fluid conduit 14 directed through the forward end 12. The forward end 12 terminates with an applicator sphere 16 or an applicator brush matrix 17 contained within a brush matrix support tube **17*a* mounted within the conduit 14 (see FIG. 6). The cylindrical body 11 includes an externally threaded rear end portion 11*a* threadedly receiving an end cap 15 that includes an internally threaded forward end 15*a* threadedly securable to the externally threaded rear end 11*a*. A forward cap 18 is securable about the forward end 12, and includes a forward cap cavity 32 (see FIG. 7) that is a complementary configuration to that of the forward end 12, with a forward cap sealing ring 33 mounted within the cavity 32 orthogonally oriented relative to an axis defined by the forward cap 18 to effect an air-tight sealing relationship of the cap about the forward applicator end to prevent air exposure and drying of the applicator end defined by the sphere 16 or brush matrix 17**.

The fluid reservoir 13 (see FIG. 3) contained coextensively throughout the cylindrical body 11 includes an eradicator fluid contained therewithin of a type known in the prior art and exemplified in U.S. Pat. No. 4,156,657 incorporated herein by reference. The fluid reservoir 13 and associated eradicator fluid is pressurized by a fluid piston 19 that is coaxially aligned relative to the cylindrical body 11 exerting pressure to the fluid contained within the fluid reservoir, wherein the fluid piston 19 includes a sealing ring 20 circumferentially mounted thereabout to effect sealing of the fluid piston within the reservoir 13. Accordingly, the sealing ring effects a sealing relationship within the interior cylindrical wall surface defined by the fluid reservoir 13. The sealing ring 20 and fluid piston 19 are coaxially aligned with a piston body 21 that is coaxially directed rearwardly of the fluid piston 19 and coaxially aligned within the end cap 15. The end cap 15 includes an end cap rear wall 28 that is orthogonally oriented relative to the axis of the end cap 15 that is also coaxially aligned relative to the cylindrical body 11. The fluid piston 19 includes a toothed side wall 22 defining spaced teeth arranged at equally spaced intervals, wherein the toothed side wall 22 is in confronting relationship relative to an end cap opening 23 that is radially directed through the end cap 15. A pressure regulating rib 24 projects through the opening 23 and is in engagement with the toothed side wall 22 and is fixedly mounted orthogonally to a support leg 25 that is fixedly mounted to an exterior surface of the cap 15 in alignment with the opening 23. The rib 24 regulates pressure directed by the piston 19 onto the fluid contained within the reservoir 13, wherein the piston 19 is biased into the reservoir by a spring member 26 that is captured between an interior surface of the end cap rear wall 28 and a piston body rear end plate 27 that is arranged parallel relative to the end cap rear wall 28.

Alternatively, (see FIG. 5) the use of modified cap **15*a* includes an internally threaded end cap cavity 29 threadedly engaged with an externally threaded piston body 30 that includes an indicator and rotation rod 31 projecting through the end cap rear wall 28 permitting rotation of the piston body 30 to effect pressurizing of fluid contained within reservoir 13**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A correction fluid dispensing pan, comprising,
   a coaxially aligned cylindrical body, and
   a coaxially aligned end cap selectively securable to the cylindrical body at a rear terminal end of the cylindrical body, and
   the cylindrical body including a conically tapered forward end, and
   a forward cap securable to the forward end, wherein the forward cap defines a forward cap cavity, and the forward cap cavity is complementarily configured to the forward end of the cylindrical body, and the forward cap cavity includes a forward cap sealing ring mounted within the forward cap cavity orthogonally oriented relative to a forward cap axis, and the cylindrical body including a fluid reservoir contained coextensively throughout the cylindrical body containing an eradicator fluid therewithin, and a fluid conduit directing fluid from the cylindrical body through the forward end of the cylindrical body, and an applicator brush matrix mounted within the forward end of the cylindrical body, and a support tube contained within the fluid conduit securing a brush matrix therewithin, wherein the brush matrix extends forwardly of the forward end of the cylindrical body, and wherein the end cap includes a fluid piston, the fluid piston including a piston body, wherein the piston body is coaxially aligned relative to the fluid piston and extends within the end cap, and the piston body includes a piston sealing ring circumferentially mounted about the piston body, wherein the sealing ring is in frictional engagement with an interior surface of the cylindrical body to effect application of pressure to the eradicator fluid contained within the fluid reservoir, and wherein the piston body includes spaced toothed members defining a toothed side wall, and the end cap includes an end cap opening radially directed through the end cap, with the toothed side wall in confronting relationship relative to the end cap opening, and a pressure regulating rib projecting through the end cap opening in engagement with the toothed side wall, the pressure regulating rib orthogonally and integrally mounted to a support leg, the support leg mounted rearwardly of the end cap opening to an exterior surface of the end cap.

2. An apparatus as set forth in claim 1 wherein the end cap includes an end cap rear wall orthogonally oriented relative to an axis defined by the end cap, and the piston body includes a piston body rear end plate oriented parallel relative to the end cap rear wall, and a spring member captured between an interior surface of the end cap rear wall and the piston body rear end plate.

3. An apparatus as set forth in claim 2 wherein the end cap and the cylindrical body are coaxially aligned.

* * * * *